US007731298B2

(12) United States Patent
Merten et al.

(10) Patent No.: US 7,731,298 B2
(45) Date of Patent: Jun. 8, 2010

(54) SHEARER-LOADER DRIVE SUBASSEMBLY AND GUIDE SHOE FOR IT

(75) Inventors: Gerhard Merten, Lünen (DE); Thomas Hoelken, Bergkamen (DE)

(73) Assignee: DBT GmbH (DE)

( * ) Notice: Subject to any disclaimer, the term of this patent is extended or adjusted under 35 U.S.C. 154(b) by 306 days.

(21) Appl. No.: 11/775,694

(22) Filed: Jul. 10, 2007

(65) Prior Publication Data

US 2008/0011585 A1 Jan. 17, 2008

(30) Foreign Application Priority Data

Jul. 13, 2006 (DE) ..... 10 2006 032 680

(51) Int. Cl.
*E21C 29/02* (2006.01)

(52) U.S. Cl. ..... 299/34.11; 299/42

(58) Field of Classification Search ..... 299/34.11, 299/42, 43, 44

See application file for complete search history.

(56) References Cited

U.S. PATENT DOCUMENTS 5,704,267 A * 1/1998 Merten et al. ..... 83/823

FOREIGN PATENT DOCUMENTS

DE 37 18 442 C1 12/1988
DE 195 31 729 A1 8/1996
DE 197 12 774 C2 1/1999

* cited by examiner

*Primary Examiner*—John Kreck
(74) *Attorney, Agent, or Firm*—Baker & McKenzie LLP

(57) ABSTRACT

A shearer-loader drive subassembly having a rotatably mounted drive sprocket, a transmission gear connected to the sprocket in a rotationally fixed manner, at least one releasable guide shoe provided for guiding the shearer loader on a rack arrangement, and a housing base plate, on which a bearing tube is supported and fastened in a rotationally fixed manner. The guide shoe is fastened by a pin which passes through the inner bore of the bearing tube and forms the pivot bearing for the guide shoe. A bearing sleeve rotatably supported on the bearing tube by a bearing may be arranged between the drive sprocket and the bearing tube, onto which bearing sleeve the drive sprocket may be pushed in a releasable manner.

13 Claims, 3 Drawing Sheets

SHEARER-LOADER DRIVE SUBASSEMBLY AND GUIDE SHOE FOR IT

CROSS-REFERENCE TO RELATED APPLICATIONS

This application claims priority to German Application No. 10 2006 032 680.6 filed on Jul. 13, 2006.

FIELD OF THE INVENTION

The invention relates to a shearer-loader drive subassembly having a rotatably mounted drive sprocket for engaging in a rack arrangement serving to propel the shearer loader, having a transmission gear arranged coaxially to the rotation axis of the drive sprocket and connected to the latter in a rotationally fixed manner, having at least one releasable guide shoe provided for guiding the shearer loader on the rack arrangement, and having a housing base plate, on which a bearing tube arranged coaxially to the rotation axis is supported and fastened in a rotationally fixed manner. The invention also relates to a guide shoe for such a shearer-loader drive subassembly, having at least one base wall, on which a guide extension for engaging underneath a rack arrangement is formed and with which the guide shoe can be releasably fastened to a housing base plate of the subassembly.

BACKGROUND OF THE INVENTION

In underground mining, the shearer loaders normally used for extracting coal are moved along a conveyor which can be advanced in the direction of working and which is overlapped by the machine body of said shearer loaders and which, in addition to guide rails for the shearer loader, also comprises a rack arrangement which is usually formed by rack bars or a chain and in which the drive sprocket of a drive subassembly of the shearer loader engages from above with its teeth. The shearer loader can then be moved along the rack arrangement by motor-operated drive of the drive sprocket. In addition, in order to ensure the reliable engagement of the tooth system of the drive sprocket in the chain or rack bar of the rack arrangement, the drive subassembly is guided on the rack arrangement by means of at least one guide element or guide shoe. On account of the high reaction forces during coal mining, on account of the high weight of the shearer loader and on account of rock fragments or the like which can possibly fall into the rack, in particular the wear of the drive sprocket of the shearer-loader drive subassembly and the wear of the guide elements is relatively high. There is therefore a fundamental need to be able to exchange the guide elements, such as the guide shoe for example, and the drive sprocket as quickly and as simply as possible if wear occurs.

In the shearer-loader drive subassembly known from DE 37 18 442 C1, the drive sprocket sits on a drive shaft which is rotatably supported with its one end in the housing base plate by means of fluid mounting. The drive shaft is supported by means of further housing plates, which for this purpose are arranged at a distance from the housing base plate. In order to ensure the sliding mounting of the drive shaft in the housing base plate, the bearing space for the intermediate gear and a gear meshing with the latter and sitting on the output shaft of the drive motor is designed to be fluid-tight.

In the shearer-loader drive subassembly of the generic type known from DE 197 12 774 A1, the drive sprocket is screwed to the transmission gear and, after removal of a cap opposite the housing base plate, can be removed together with the bearing tube and the bearings. The guide shoe comprises a specially designed hook which engages both underneath and behind a bottom guide strip on a rack bar or the like. The assembly cost and changeover cost is relatively high, since in the event of a repair a construction unit consisting of drive sprocket, transmission gear, bearings and bearing shaft has to be dismantled. The dismantling therefore cannot be carried out without lifting gear.

The object of the invention is to provide a shearer-loader drive subassembly and a guide shoe for it which permit simple fitting or removal, which can be carried out quickly, of the wearing parts such as, in particular, drive sprocket and guide shoe.

This object is achieved according to the invention in the case of the shearer-loader drive subassembly in that the guide shoe is fastened to the base plate by means of a releasable pin which passes through the inner bore of the bearing tube and forms the pivot bearing for the guide shoe, and/or in that a bearing sleeve rotatably supported on the bearing tube by means of at least one bearing is arranged between the drive sprocket and the bearing tube, onto which bearing sleeve the drive sprocket is pushed or can be pushed in a releasable manner from the bearing tube end remote from the housing base plate. In the solution according to the invention with regard to the guide shoe, it is only necessary for a pin serving at the same time as a pivot bearing for the guide shoe to be released and removed in order to then release the guide shoe preferably downward from the drive subassembly. In this case, this pin passes through the inner bore of the bearing tubes such that the pivot axis for the guide shoe coincides with the rotation axis of the drive sprocket. The removal of a pin enables the guide shoe to be removed extremely rapidly without other elements of the drive subassembly having to be released or removed for this purpose. The pivotable mounting of the guide shoe at the same time improves the guidance behavior of the drive subassembly on the rack arrangement and increases the service life of the guide shoe. A second solution concept according to the invention proposes, for the shearer-loader drive subassembly, a mounting of the drive sprocket in which only the drive sprocket, preferably after prior requisite removal of the guide shoe, is removed, whereas all the subassembly elements serving for mounting the drive sprocket and the bearings remain in the fitted state in the drive subassembly. By means of this measure, which is achieved by virtue of the fact that the drive sprocket is fastened only indirectly in the drive subassembly, with a bearing sleeve in between which is rotatably supported on the bearing tube, the fitting or removal of the drive sprocket is considerably simplified. For the fitting or removal of the drive sprocket, it is no longer necessary to fit or remove the bearing tube together with associated mounting, since the bearing tube remains fastened to the housing base plate.

In a preferred configuration of a shearer-loader drive subassembly, the bearing sleeve is rotatably supported on the bearing tube by means of a single bearing arranged in a bearing section of the bearing sleeve and has a sleeve section which extends up to a second bearing, onto which the hub of the transmission gear is pushed, preferably directly. The sleeve section of the bearing sleeve therefore at the same time provides for the requisite distance of the bearing or bearing section of the bearing sleeve from the second bearing. This distance is required in order to be able to fit the drive sprocket and arrange it next to the transmission gear. It is especially advantageous if the bearing tube and the bearing sleeve each comprise a shoulder for arranging the first bearing, which shoulders firstly restrict or minimize the axial play of bearing and bearing sleeve and secondly ensure that the respective tube thicknesses of the bearing tube and the bearing sleeve do not become excessively large. The first and/or the second bearing can preferably consist of twin-row antifriction bearings.

In the especially preferred configuration, the drive sprocket is releasably screwed to the transmission gear by means of axial screws. The rotationally locked connection between drive sprocket and transmission gear is expediently assisted by means of feather keys and/or a splined shaft connection between the two gears in order to protect the axial screws from shearing loads. According to an advantageous configuration, the drive sprocket, on a side wall, comprises a collar which engages in a rotationally locked manner in a recess in the side flank of the transmission gear. In an especially advantageous configuration, the drive sprocket, on the opposite side wall, may then have an annular collar which extends beyond the first bearing up to the free sleeve end, remote from the housing base plate, of the bearing sleeve and which is preferably provided with a circumferential groove for the engagement of a pull-off tool or the like for the drive sprocket. In this configuration, provision may be made at the same time for the annular collar to be provided with a spherical surface. During operational use, the drive sprocket can then at the same time roll on the top side of the rack arrangement by means of the spherical surface of the annular collar.

According to an especially advantageous configuration of the shearer-loader drive subassembly according to the invention, the guide shoe is of one-piece design and has a base wall having a guide extension for engaging underneath the rack arrangement and, opposite the base wall, an opposing wall having a guide extension for engaging behind the rack arrangement. A one-piece guide shoe which not only engages underneath the rack arrangement but at the same time also engages behind it ensures that the drive subassembly of the shearer loader is reliably guided on the rack arrangement both vertically and transversely to the direction of movement of the shearer loader and disengagement of the drive sprocket from the rack bar or chain of the rack arrangement is effectively prevented. The guide shoe can be fitted or removed in an especially simple manner if the pin projects on both sides from the bearing tube and, for the pivotable mounting of the guide shoe, engages in through-openings in the base wall and the opposing wall of the guide shoe. The pin may consist in particular of a one-piece push-in pin which is secured against release in its fitted position by suitable pin retention means.

The above object is preferably achieved in the case of a guide shoe according to the invention in that a first through-opening formed in the base wall is provided in alignment with a second through-opening formed in an opposing wall opposite said base wall, the two through-openings serving for the engagement and passage of a pin, which can be inserted into a subassembly-side bearing tube, for the pivotable mounting and support of the guide shoe. The guide shoe pivotably mounted on two opposite walls can not only be completely removed by simple removal of the pin, but is at the same time advantageously supported over its entire width for pivoting. It is also especially advantageous in the case of the guide shoe if it is of one-piece design and has a base wall having a guide extension for engaging underneath the rack arrangement and an opposing wall having a guide extension for engaging behind the rack arrangement. A space open at the top and bottom is expediently formed between the base wall and the opposing wall, in which space, in the fitted state of the guide shoe on the drive subassembly, the drive sprocket is arranged in a plunging manner in such a way that its teeth can engage in the rack arrangement.

BRIEF DESCRIPTION OF THE SEVERAL VIEWS OF THE DRAWINGS

Further advantages and configurations of a shearer-loader drive subassembly according to the invention and of a guide shoe according to the invention follow from the description below of a preferred exemplary embodiment shown in the drawing, in which.

DETAILED DESCRIPTION OF THE INVENTION

Figure 1:
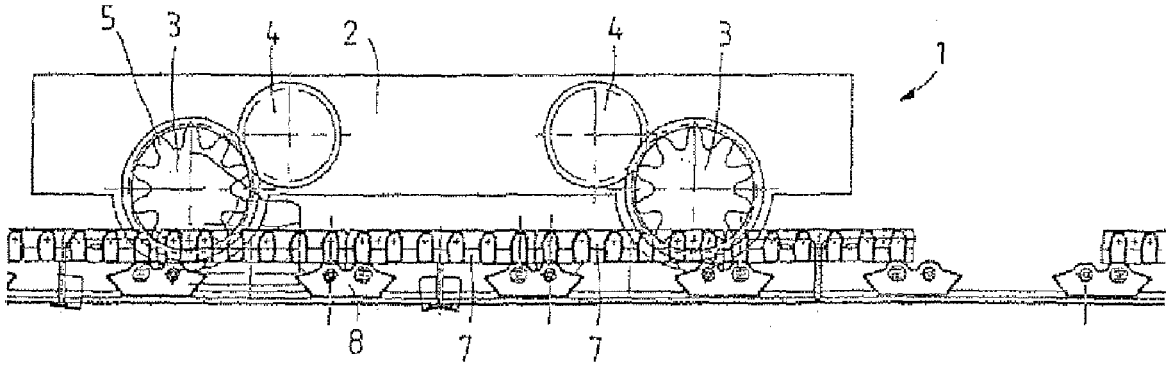
FIG. 1 schematically shows a shearer loader guided on rack bars in a view toward its drive sprockets.

Shown schematically in FIG. 1 is a shearer loader 1 whose body 2, to which tool drums fitted with working tools are fastened on swivel arms (not shown), overlaps an underground face conveyor (likewise not shown in FIG. 1) in a portal-like manner. The shearer loader 1 shown comprises, for both possible directions of movement, a drive sprocket 3, which is driven by a respective associated drive motor, of which in each case only the output-side gear 4 is shown. The teeth 5 of the drive sprockets 3 engage from above in the gaps of rack bars 7, which are fastened in a removable manner to blocks 8, which in turn are fastened on the working-face side to side cheeks of a face conveyor laid along the underground face, as shown by way of example on the conveyor pan 9 only shown in FIG. 2. Since the construction of an underground face conveyor composed of conveyor pans, as partly shown in FIG. 2, is known to the person skilled in the art, the associated conveyor pans are not described further here.

Figure 2:
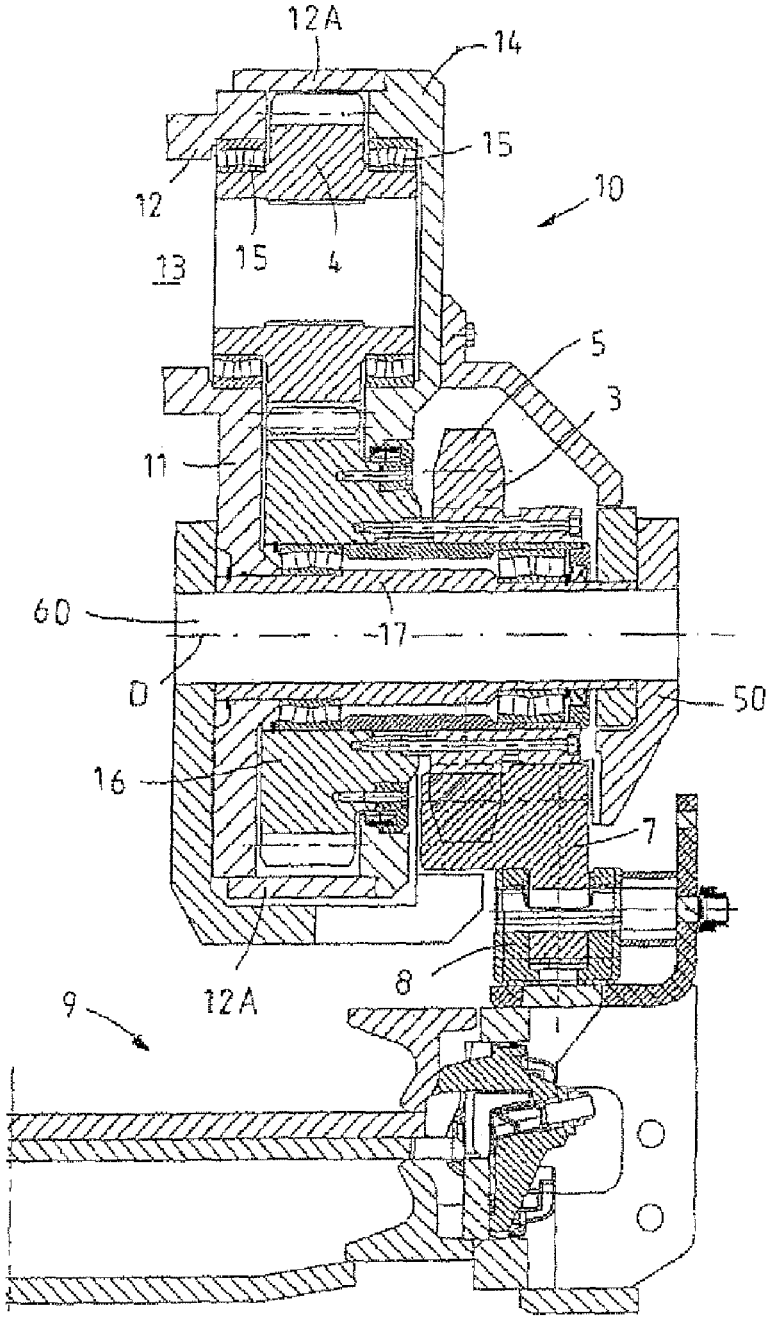
FIG. 2 shows in a vertical section, partly truncated, one of the two shearer-loader drive subassemblies in engagement with a rack arrangement fastened to a face conveyor.
Figure 3:
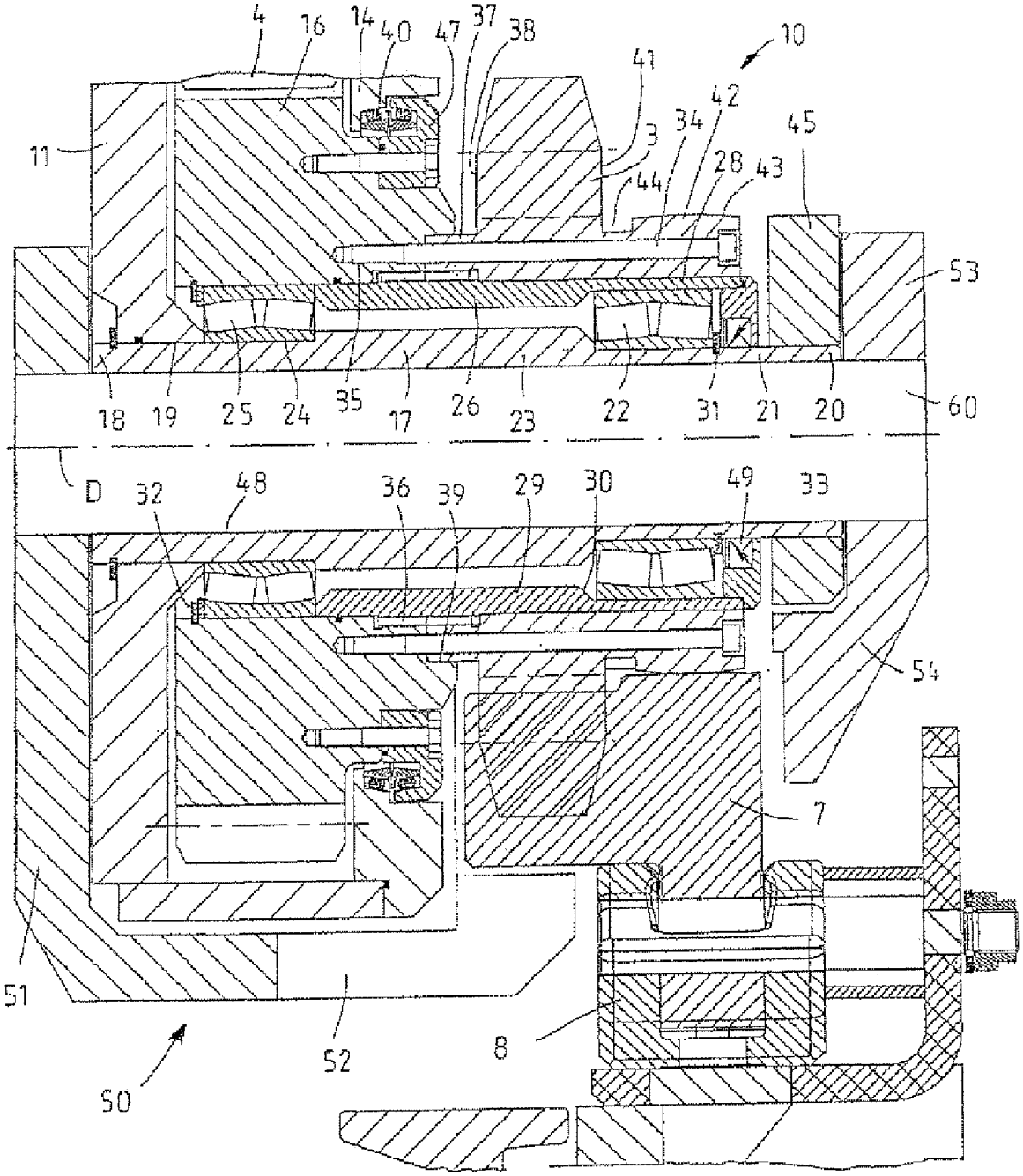
FIG. 3 shows the drive subassembly from FIG. 2 in an enlarged illustration.

FIGS. 2 and 3 show a completely fitted shearer-loader drive subassembly 10 of a shearer loader for coal winning in operation use, in which the teeth 5 of the drive sprocket 3 of the drive subassembly 10 engage in gaps in the rack bars 7 of the rack arrangement. The entire drive subassembly 10 is supported on the body (2; FIG. 1) of the shearer loader via a housing base plate 11 which is connected to said body via a crosspiece 12. The gear 4 is mounted by means of a plurality of antifriction bearings 15 between a central aperture 13 in the crosspiece 12 and a housing shell 14 connected to the base plate 11 via struts 12A, said gear 4 being coupled in a rotationally fixed manner to an output shaft (not shown) of the motor (not shown) and meshing by means of its spur tooth system with the spur tooth system of a transmission gear 16 which is mounted together with the drive sprocket 3 and coaxially to the latter in drive subassembly 10. The drive sprocket 3 and the transmission gear 16 are mounted so as to be rotatable about a common rotation axis D and are connected to one another in such a way as to rotate together. The mounting of both the drive sprocket 3 and the transmission gear 16 on a bearing tube 17 fastened in a rotationally fixed manner to the base plate 11 will now be explained first of all with reference to FIG. 3.

With its one tube end 18, the bearing tube 17 is fastened inside a fastening receptacle 19 in the base plate 11 in such a way that the bearing tube 17 of relatively sturdy proportions is suspended essentially only on one side and forms the bearing axis for the transmission gear 16 and the drive sprocket 3. Starting from its free tube end 20, the bearing tube 17 is provided with a first shoulder 21, on which a first antifriction bearing 22, which is designed as a twin-row angular-contact roller bearing, is supported with its inner bearing ring. Between a center section 23 and the tube end 18 fastened to the base plate 11, the bearing tube has a second shoulder 24, on which a second twin-row antifriction bearing 25 sits. A bearing sleeve 26 is rotatably supported with the first antifriction bearing 22. The bearing sleeve is supported on one side in the region of a bearing section 28 which is stepped in diameter on the inner circumference of the bearing sleeve 26, and the bearing sleeve comprises a sleeve section 29 which extends from the step 30 between the two sections 28, 29 up to the second antifriction bearing 25. The first antifriction bearing 22 is secured to the shoulder 21 of the bearing tube by means of a first retaining ring 31, and the second antifriction bearing 25 is secured to the inner circumference of the hub of the transmission gear 16 by means of a retaining ring 32. By the two antifriction bearings 22, 25 being fixed axially, the rotatable bearing sleeve 26 is at the same time secured against axial displacement from its fitted position. A closure ring 33 accommodating a shaft seal 49 is fastened to the free sleeve end of the bearing sleeve 26 in order to protect the bearings 22, 25 from the ingress of dirt and moisture. It can readily be seen from FIG. 3 that the outer circumference of the bearing sleeve 26 is in alignment with the outer circumference of the second antifriction bearing 25 and that the drive sprocket 3 is pushed with its hub onto the outer circumference of the bearing sleeve 26. A plurality of axial screws 34 are provided all round for the axial connection between the drive sprocket 3 and the transmission gear 16 arranged coaxially to said drive sprocket 3, said axial screws 34 passing axially through the entire drive sprocket 3 and being screwed into tapped holes 35 in the transmission gear 16. In addition, rotary locking is effected between the drive sprocket 3 and the transmission gear 16 via feather keys 36 and/or by means of a collar 37 on a side wall 38 of the drive sprocket 3, said collar 37 engaging in a positive-locking manner in a recess 39, formed concentrically to the hub, in that end face of the transmission gear 16 which faces the drive sprocket 3. In this case, there is preferably a suitable splined shaft connection (not shown) between the collar 37 and the recess 39. The transmission gear 16 is directly supported on the bearing tube 17 by means of the second antifriction bearing 25 arranged in its hub. Furthermore, a locating ring 47 accommodating sliding rings 40 is arranged on the transmission gear 16 on the end face facing the drive sprocket 3 in order to also obtain a seal relative to the housing shell 14. On the outer housing wall 41, the drive sprocket 3 has a projecting annular collar 42 having a spherically arched surface 43. During operational use, the annular collar 42 can roll on the top side of the rack bar 7.

The bearing tube 17 serves not only to support the bearings 22, 25 for mounting the drive sprocket 3 and the transmission gear 16 but also at the same time to fasten a guide shoe 50 which engages underneath the rack bar 7 by means of a guide extension 52 formed on a base wall 51 and engages behind a side flank of the rack bar 7 by means of a guide extension 54 formed on an opposing wall 53 opposite said base wall 51. By the interplay of guide extension 52 and guide extension 54, the entire shearer-loader drive arrangement 10 is guided relatively closely to the rack bar 7, such as to prevent the teeth of the drive sprocket 3 from being disengaged from the tooth gaps in the rack bar 7. The guide shoe 50 is fastened by means of a push-in pin 60 which is inserted into the inner bore 48 of the bearing tube 17 and projects on both sides beyond the bearing tube ends 18, 20. As can readily be seen from FIG. 3, the projecting sections of the pin 60 engage in through-openings in the base wall 51 and the opposing wall 53 of the guide shoe 50.

Figure 4:
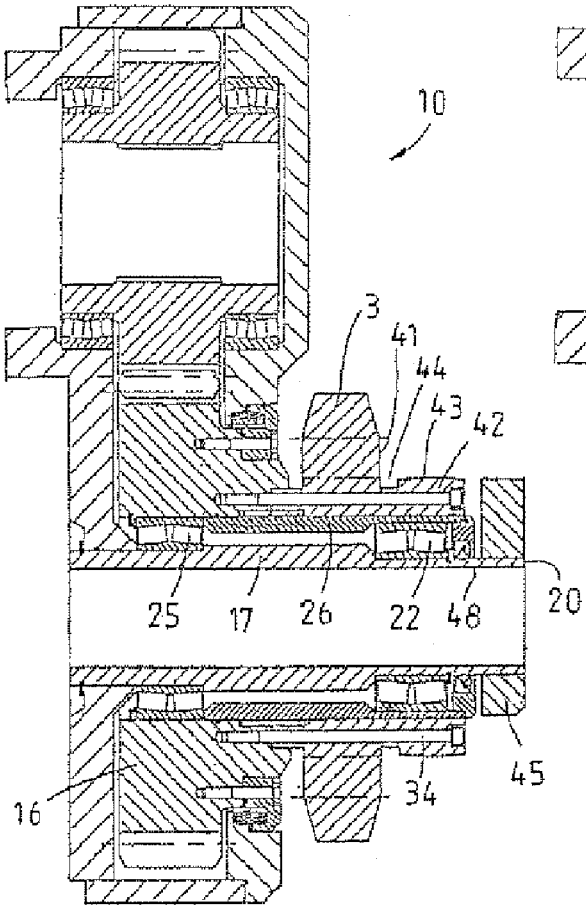
FIG. 4 shows the drive subassembly in a sectional view according to FIG. 2 with guide shoe removed.
Figure 5:
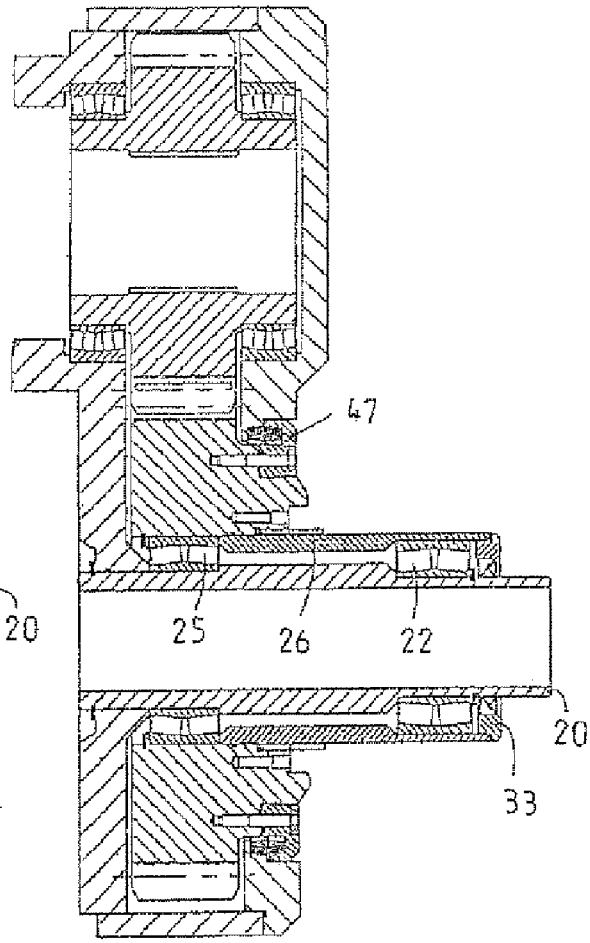
FIG. 5 shows the drive subassembly in a sectional view according to FIG. 2 with drive sprocket additionally removed.

The above-described mounting of the drive sprocket 3 on a bearing sleeve 26 rotatably supported on the bearing tube 17 permits especially simple fitting and removal and thus especially simple exchange, which can be carried out quickly, of the drive sprocket 3. Reference is made in this respect to FIGS. 4 and 5. In the illustration in FIG. 4, the guide shoe shown in FIG. 3 has already been removed by removing the pin (60, FIG. 3) of sturdy design which holds said guide shoe and passes through the inner bore of the bearing tube 17, in which case the guide shoe can only be removed if the drive subassembly 10 of the shearer loader is located above a gap within the rack arrangement, as shown in FIG. 1 in the right-hand half. The guide shoe can be removed downward only after the rack is removed, after the retaining pin has also been pulled out of the inner bore of the bearing tube 17, and this state is shown in FIG. 4. In a next removal step for removing the drive sprocket 3, an intermediate disk 45 which is arranged as a spacer between the opposing wall of the guide shoe and the bearing sleeve 26 is then removed. After removal of the intermediate disk 45, the axial screws 34 can be released, as a result of which the axial connection between the drive sprocket 3 and the transmission gear 16 is released. Between the annular collar 42 and the side wall 41, the drive sprocket 3 is provided with a groove 44, in which, after the axial screws 34 have been released, a suitable releasing tool, such as a pull-off tool, can engage in order to pull the drive sprocket 3 off the bearing sleeve 26 over the free end 20 of the bearing tube 17. FIG. 5 shows the final state after removal of the drive sprocket from the bearing sleeve 26 and the bearing tube 17. The drive sprocket has been removed, although all the other elements serving for the mounting and for sealing the mounting, such as, in particular, the cap 33 having the shaft seal and the locating ring 47 having the sealing rings and also the bearings 22 and 25, remain in the fitted position. For the fitting of a possibly renewed drive sprocket, said drive sprocket then only needs to be pushed again with its hub over the free end 20 of the bearing sleeve 26 onto the outer circumference of the latter in order to then restore the operating position while coupling the splined shaft connection or the spline tooth system and fastening the axial screws.

Figure 6:
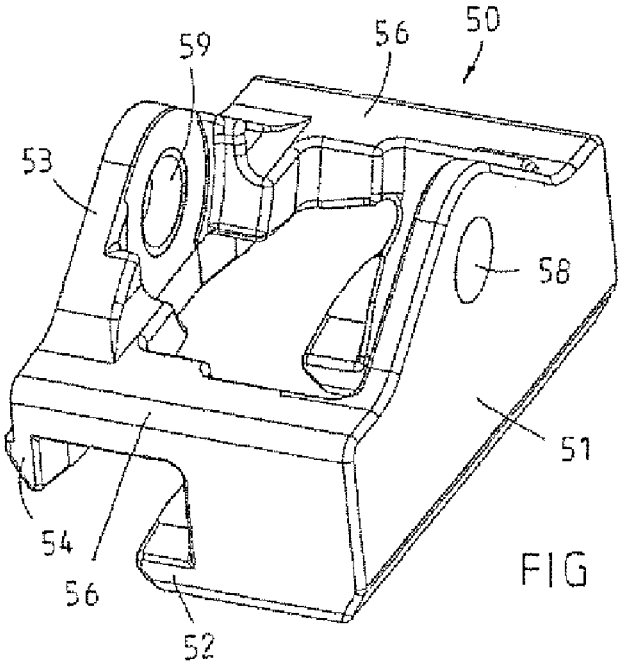
FIG. 6 shows a guide shoe according to a preferred exemplary embodiment in a perspective view.
Figure 7:
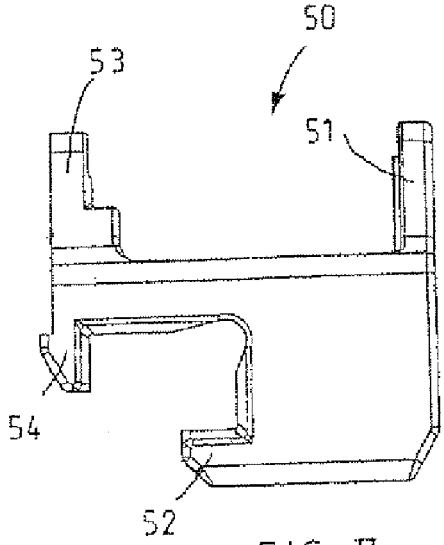
FIG. 7 shows a view of the front side of the guide shoe from FIG. 6.

As already explained further above, the guide shoe 50 can be pivotably fixed to the drive subassembly 10 and released from the latter by fitting and respectively removing a pin (60, FIG. 3) passing through the inner bore 48 of the bearing tube 17. A guide shoe 50 advantageously designed in this respect is shown in detail in FIGS. 6 and 7. The base wall 51 having the sturdy guide extension 52 engaging underneath the rack arrangement defines on one side a space open at the top and bottom and is connected, via transverse struts 56 integrally cast in one piece, to the opposing wall 53, on the underside of which the second guide extension 54 for engaging behind the rack arrangement is formed. Both the base wall 51 and the opposing wall 53 are each provided with through-openings 58 and 59, respectively, which are in alignment with one another and in which the fastening pin engages in the fitted state. In interplay with the through-openings 58, 59, the fastening pin forms a pivot bearing for the guide shoe 50, which can therefore move slightly during operational use and can adapt itself to angular configurations between adjacent rack bars.

The invention is not restricted to the exemplary embodiment described and the person skilled in the art can deduce numerous modifications which are to come within the range of protection of the attached claims. The configuration of the drive sprocket and of the transmission gear can be varied in many different ways. The geometry and the number of teeth of the drive sprocket may also vary if the rack arrangement comprises rack bars of different form or a rack-type chain.

We claim:

1. A shearer-loader drive subassembly, comprising:

a rotatably-mounted drive sprocket for engaging in a rack arrangement adapted to propel the shearer-loader;

a transmission gear arranged coaxially to a rotation axis of the drive sprocket and connected to the drive sprocket in a rotationally-fixed manner;

at least one releasable guide shoe provided for guiding the shearer-loader on the rack arrangement; and a housing base plate on which a bearing tube arranged coaxially to the rotation axis of the drive socket is supported and fastened in a rotationally-fixed manner, wherein the guide shoe is fastened to the base plate by a releasable pin that passes through an inner bore of the bearing tube and forms a pivot bearing for the guide shoe.

2. The shearer-loader drive subassembly of claim 1, further comprising:

a bearing sleeve rotatably supported on the bearing tube by at least one first bearing, wherein the bearing sleeve is arranged between the drive sprocket and the bearing tube; and the drive sprocket is pushed onto the bearing sleeve in a releasable manner from a bearing tube end remote from the housing base plate.

3. The shearer-loader drive subassembly of claim 2, wherein the bearing sleeve is supported on the bearing tube by the at least one first bearing arranged in a bearing section of the bearing sleeve and has a sleeve section which extends up to a second bearing, onto which a hub of the transmission gear is pushed.

4. The shearer-loader drive subassembly of claim 2, wherein the bearing tube and the bearing sleeve each include a shoulder for arranging the at least one first bearing.

5. The shearer-loader drive subassembly of claim 3, wherein at least one of the first bearing or the second bearing includes a twin-row antifriction bearing.

6. The shearer-loader drive subassembly of claim 1, wherein the drive sprocket is connected to the transmission gear by at least one axial screw; and the drive sprocket is coupled to the transmission gear by at least one of feather keys or a splinted shaft connection.

7. The shearer-loader drive subassembly of claim 6, wherein the drive sprocket includes a first side wall and at least one collar located on the first side wall;

the transmission gear includes at least one side flank and at least one recess located in the at least one side flank; and the at least one collar is engaged in the at least one recess in a rotationally-locked manner.

8. The shearer-loader drive subassembly of claim 7, wherein the drive sprocket includes a second side wall and at least one annular collar located on the second side wall;

the at least one annular collar extends beyond the first bearing up to the end face of the bearing sleeve; and the at least one annular collar is includes a circumferential groove operable for use of a pull-off tool.

9. The shearer-loader drive subassembly of claim 8, wherein the at least one annular collar includes a spherically arched surface.

10. The shearer-loader drive subassembly of claim 1, wherein the guide shoe is of one-piece design and includes a base wall having a guide extension for engaging underneath the rack arrangement; and the guide shoe includes an opposing wall opposite the base wall, the opposing wall having a guide extension for engaging behind the rack arrangement.

11. The shearer-loader drive subassembly of claims 1, wherein the releasable pin projects on both ends from the bearing tube and engages in a first through-opening located in a base wall of the guide shoe and in a second through opening located in an opposing wall of the guide shoe.

12. A guide shoe for a shearer-loader drive subassembly, comprising:

at least one base wall including a first through-opening adapted to accept and engage a pin;

at least one opposing wall located opposite the at least one base wall and having a second through-opening adapted to accept and engage the pin;

a guide extension formed on the at least one base wall, the guide extension adapted to engage underneath a rack arrangement and to releasably fasten the guide shoe to a base plate of the subassembly; and a subassembly-side bearing tube, wherein the pin is inserted into the subassembly-side bearing tube for the pivotable mounting and support of the guide shoe.

13. The guide shoe of claim 12, wherein the guide shoe is of one-piece design; and the opposing wall includes a second guide extension for engaging behind the rack arrangement.

* * * * *